US005280147A

United States Patent [19]

Mochizuki et al.

[11] Patent Number: 5,280,147

[45] Date of Patent: Jan. 18, 1994

[54] KEYSWITCH ASSEMBLY WITH A KEY SUPPORT LIMITING TRANSVERSE, LONGITUDINAL AND ROTATIONAL MOVEMENT OF THE KEY

[75] Inventors: Isao Mochizuki, Kaizu; Takeyuki Takagi, Nagoya, both of Japan

[73] Assignee: Brother Kogyo Kabushiki Kaisha, Nagoya, Japan

[21] Appl. No.: 967,977

[22] Filed: Oct. 28, 1992

[30] Foreign Application Priority Data

Nov. 19, 1991 [JP] Japan ..... 3-330160
Feb. 14, 1992 [JP] Japan ..... 4-005894[U]

[51] Int. Cl.[5] ..... H01H 3/12
[52] U.S. Cl. ..... 200/344; 200/517
[58] Field of Search ..... 200/344, 517

[56] References Cited

U.S. PATENT DOCUMENTS 3,174,685 3/1965 Swanson .
3,857,007 12/1974 Leuenberger .
4,433,225 2/1984 Cowles .
4,560,844 12/1985 Takamura et al. .
4,560,845 12/1985 Takamura et al. .
4,580,022 4/1986 Oelsch et al. ..... 200/344
4,735,520 4/1988 Suzuki et al. .
4,902,862 2/1990 Oelsch et al. ..... 200/344

FOREIGN PATENT DOCUMENTS 0134509 3/1985 European Pat. Off. .
0142593 5/1985 European Pat. Off. .
0295437 12/1988 European Pat. Off. .
2175105 10/1973 France .
2-5236 1/1990 Japan ..... 200/344
4-76224 7/1992 Japan .

*Primary Examiner*—Renee S. Luebke
*Attorney, Agent, or Firm*—Oliff & Berridge

[57] ABSTRACT

The present invention provides a keyswitch assembly enabling a keyboard employing the same to be formed in a small thickness without sacrificing the stroke of the key to the reduction of thickness of the keyboard, facilitating keystroke operation and securing reliable keystroke. The keyswitch assembly has a key supported on a base plate by a support mechanism formed by pivotally connecting first and second support levers each provided with pivots at their opposite ends in a scissors-like form by a pivotal joint. The support levers are connected to the key and the base plate by fitting the pivots thereof in round holes and horizontally elongate grooves formed in the key and in round holes and horizontally elongate grooves formed in the base plate. When the key is depressed, the first and second support levers turn on the pivots fitted pivotally in the round holes and the pivotal joint compresses a rubber spring disposed under the support mechanism for switching.

62 Claims, 13 Drawing Sheets

| | |
|---|---|
| X | (P, S ARE NOT SLIDABLE IN X-DIRECTION) AND (R1=R2=R3) |
| H | (P, S ARE NOT SLIDABLE IN X-DIRECTION) AND (R1=R2=R3=R4) |
| Y | (U, V ARE NOT SLIDABLE IN Y-DIRECTION) OR (W, Z ARE NOT SLIDABLE IN Y-DIRECTION) |
| R | U, V ARE NOT SLIDABLE IN X-DIRECTION |

KEYSWITCH ASSEMBLY WITH A KEY SUPPORT LIMITING TRANSVERSE, LONGITUDINAL AND ROTATIONAL MOVEMENT OF THE KEY

BACKGROUND OF THE INVENTION

1. Field of the Invention

The present invention relates to a keyswitch assembly and, more particularly, to a keyswitch assembly suitable for use on a thin keyboard for a portable word processor, a portable personal computer or the like.

2. Description of Related Art

A known keyswitch assembly for use on such a keyboard has a key provided with a stem, a base plate provided with a key support having a hole receiving the stem of the key to guide the key for vertical movement, and a switching member, such as a membrane switch, disposed under the stem. When the key is depressed, the lower end of the stem of the key presses the switching member for switching action.

A keyswitch assembly provided with a large key, such as a space key and a return key, is provided with a mechanism for maintaining the key in a level position when the key is depressed. Such keyswitch assemblies are disclosed in U.S. Pat. Nos. 4,580,022, 4,902,862 and 4,433,225.

In a keyswitch assembly disclosed in the '022 patent, a key member is supported on support levers connected with pins in a scissors-like form, and switching members are disposed apart from the central portion of the key member. Pins attached to the opposite ends of the support levers slide horizontally along the inner surface of the key member and the upper surface of a base plate when the key member is depressed. Stems formed in the key member and guided by a guide member slide vertically to compress the switching members when the key member is depressed.

A keyswitch assembly disclosed in the '862 patent is the same in basic construction as the keyswitch assembly disclosed in the '022 patent and is characterized in that the key member can be easily connected to and removed from the support levers.

In the '225 patent, a keyswitch assembly including an L-shaped keytop is disclosed. The keyswitch assembly comprises a pair of lever arms joined at intermediate portions thereof by a pivot to form a scissors-like linkage having first, second, third, and fourth ends. The first and second ends of the scissors-like linkage are pivotally slidable within the cantilevered portion of the keytop. However, a keyswitch portion is separately disposed from the scissors-like linkage. So, there is a problem that the keyswitch is not perfectly operated. Furthermore, a plunger is needed, so the assembly requires many parts, and the structure is complex.

In these prior art keyswitch assemblies disclosed in the above references, the key member is maintained in a level position regardless of the position at which pressure is applied to the key member, when the key member is moved vertically, even if the key member is a large key member, such as a space bar.

In any of these prior art keyswitch assemblies, the stem for compressing the switching member or the key depressing member is guided for vertical sliding movement by the guide member in compressing the switching member.

Recent progressive reduction in size and thickness of word processors and personal computers requires reduction in size and thickness of keyboards to be incorporated into word processors and personal computers. On the other hand, the stroke of the keys of keyboards must be sufficiently large to facilitate keystroke operation and to secure a reliable keystroke. However, the stroke of the keys of the prior art keyswitch assemblies, which are generally used, is not sufficiently large.

In reducing the thickness of a keyboard provided with the generally used prior art keyswitch assemblies, the length of a sliding portion of the stem in sliding engagement with the guide member must be reduced. However if the length of the sliding portion of the stem is reduced, the key is liable to tilt relative to the guide member and, consequently, the stem is liable to slide awkwardly in the guide member when the key is depressed. If the length of the sliding portion of the stem in engagement with the guide member is increased to ensure smooth movement of the key, the stroke of the key is reduced. Thus, the effort of reducing the thickness of the keyboard by reducing the sliding portion of the stem and the effort of securing smooth movement of the key are contradictory.

If the stem of the key slides awkwardly in the guide member when the key is depressed, noise is generated and the ease of the keystroke operation is deteriorated. However, the misalignment of the stem with the guide member does not occur very of ten if the key is always depressed in the central portion thereof. Hence, it may be possible to obviate the misalignment of the stem with the guide member by forming the upper surface of the key as a small area so that the key is always depressed in the central portion thereof, which also will deteriorate facility in keystroke operation.

The keyswitch assemblies disclosed in the foregoing references are not intended to enable the reduction of the thickness of the keyboard and, since the stem for compressing the switching member must be projected from the key, it is difficult to form those keyswitch assemblies in a relatively small thickness. Further, the key provided with the stem has a complicated shape and hence increases the cost of the keyswitch assemblies.

Furthermore, since the pivots formed at the extremities of the support levers slide horizontally along the inner surface of the key and the upper surface of the base plate, respectively, the position of the key with respect to horizontal directions is indefinite. Consequently, it is possible that the key is dislocated horizontally when depressed, and the stem is unable to operate the switching member reliably.

In particular in the '225 patent, the keyswitch is poorly operated because the keyswitch is separately disposed from the scissors-like linkage. In addition, there is the problem that many parts are needed because such a keyswitch assembly requires a plunger.

SUMMARY OF THE PRESENT INVENTION

The present invention has been made to solve the above and other problems in the prior art. It is therefore an object of the present invention to provide a keyswitch assembly omitting the guide member for guiding the stem of the key, which is capable of enabling a keyboard employing the keyswitch assembly to be formed in a small size and in a small thickness without sacrificing the stroke of the key to the reduction of thickness of the keyboard. The assembly according to the present invention also has a simple construction, easy keystroke operation and is capable of securing a reliable keystroke.

In a first aspect of the present invention, a keyswitch assembly comprises: a key; a base plate disposed beneath the key; key support means for supporting the key for vertical movement with respect to the base plate, comprising first and second levers, the first lever having a first end pivotally connected to the key, a second end slidably connected to the base plate and a body, the second lever having a first end slidably connected to the key, a second end pivotally connected to the base plate and a body, the body of the first lever and the body of the second lever being pivotally joined and forming a scissors type mechanism with a pivot joint; and a resilient switching member disposed between the base plate and the key support means beneath the pivot joint, wherein upon compression of the key support means the pivot joint bears on the switching member.

In the keyswitch assembly in the first aspect of the present invention, when the key is depressed for switching action, the two pivotally connected support levers of the support mechanism turn on the pivotal joint respectively in opposite directions and the pair of pivots formed at the opposite ends of each of the support levers move in the first and second projections, the switching member is compressed by the pivotal joint for switching action and, when the pressure is removed from the key, the support levers are returned to their original positions together with the key by the resilient restoring force of the switching member.

Since one of the two pairs of first projections and one of the two pairs of second projections, on one side of a vertical line passing the center of the pivotal joint are provided with holes pivotally receiving the pivots of the support levers, and the other pair of first projections and the other pair of second projections on the other side of the vertical line are provided with horizontally elongate grooves in which the pivots of the support levers are able to slide horizontally, the pivots fitted in the holes of the former pair of first projections and the former pair of second projections turn in the holes and the pivots received in the grooves of the latter pair of first projections and the latter pair of second projections slide along the grooves when the support members are turned.

Since the keyswitch assembly in accordance with the present invention connects the two support levers by the pivotal joint at a position corresponding to the switching member and the switching member is compressed by the pivotal joint, the keyswitch assembly of the present invention need not be provided with any particular mechanism, such as the stem and the stem guide member needed by the prior art keyswitch assemblies, to compress the switching member.

Thus, the present invention enables a keyboard to be formed in a relatively small thickness without sacrificing the stroke of the keys to the reduction of thickness of the keyboard. The design facilitates keystroke operation and secures a reliable keystroke, using a key of simple form to provide a keyswitch assembly at a low cost. Since the keyswitch assembly need not be provided with a key having a stem and a guide member for guiding the stem of the key, the keyswitch assembly does not generate any noise attributable to the sliding movement of the stem in the guide member when the key is operated. Further, the upper surface of the key of the keyswitch assembly of the present invention need not be formed in a small area to ensure applying pressure to the central portion of the upper surface of the key in depressing the key.

Since the pivots fitted in the holes of the projections turn in the holes, respectively, and do not move horizontally, the key does not shift horizontally when depressed, which further enhances the facility in key stroke operation and the reliability of the keystroke.

BRIEF DESCRIPTION OF THE DRAWINGS

The above and other objects, features and advantages of the present invention will become more apparent from the following description taken in connection with the accompanying drawings, in which:

FIG. 17(A) is a schematic drawing of a side view of the key support mechanism shown in FIG. 4 showing the positional relationships of the levers and the directions of restricted movement of the key;

FIG. 17(B) is a schematic drawing of a plan view of the key support mechanism shown in FIG. 12 showing the directions of restricted movement of the key;

DESCRIPTION OF PREFERRED EMBODIMENTS

Figure 1:
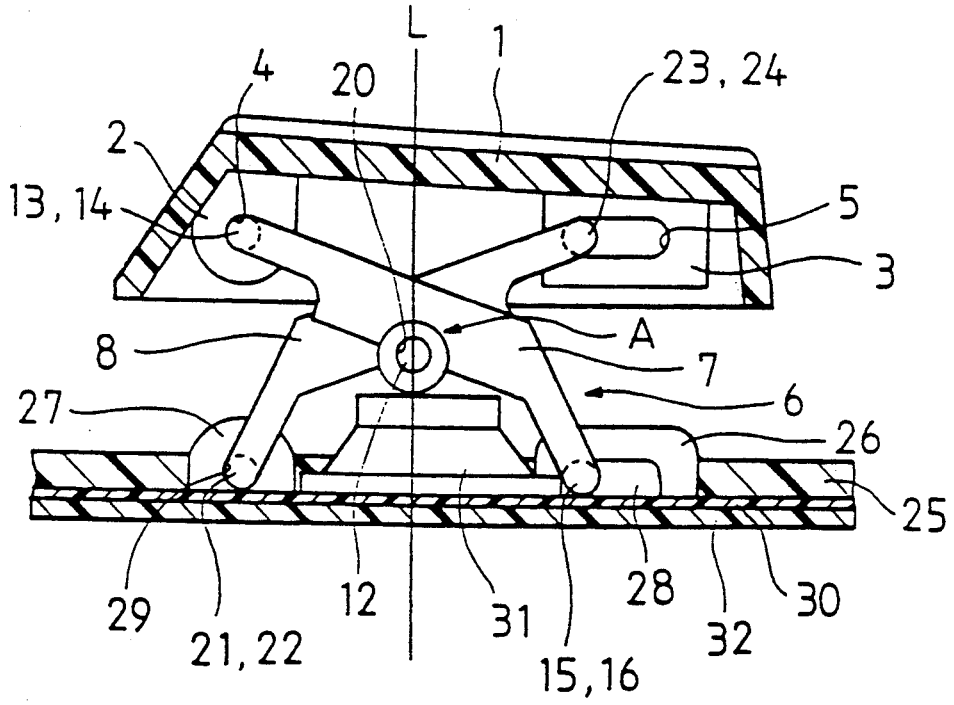
FIG. 1 is a sectional side view of a keyswitch assembly in a first embodiment according to the present invention.

A keyswitch assembly in a first embodiment according to the present invention will be described with reference to FIGS. 1 to 3. Referring to FIG. 1, a character such as an alphabetic character is formed by printing or the like on the upper surface of a key 1, preferably of a synthetic resin, such as ABS resin, by molding. A pair of first upper projections 2 and a pair of second projections 3 are formed integrally with the key 1 so as to project downward from the inner surface of the key 1.

The first upper projections 2 are connecting parts provided with round holes 4 for pivotally receiving pivots 13 and 14 formed at the upper end of a first support lever 7. The second upper projections 3 are connecting parts provided with elongate slots or grooves 5 for slidably receiving pivots 23 and 24 formed at the upper end of a second support lever 8 so that the pivots 23 and 24 are able to slide horizontally along the grooves 5. The support levers 7 and 8 are pivotally joined in a scissors-type linkage with a pivot axis by a pivotal joint to form a support mechanism 6.

Figure 2:
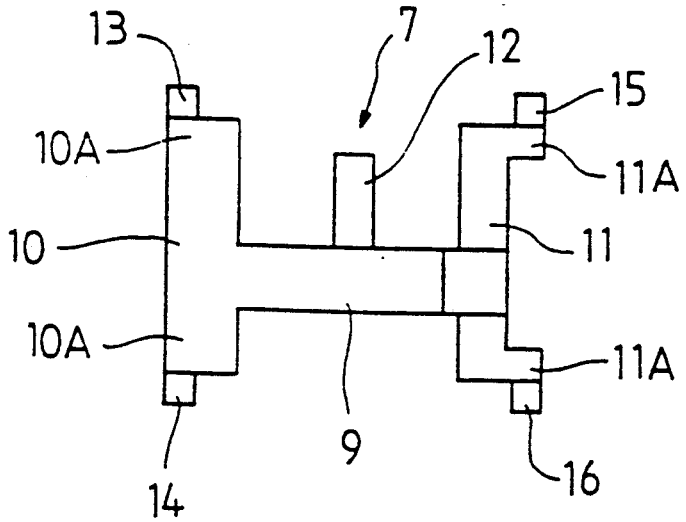
FIG. 2 is a plan view of one of the support levers included in the keyswitch assembly of FIG. 1.

As shown in FIG. 2, the first support lever 7 has, in an integral unit, a body 9, two arms 10 and 11 formed respectively at the opposite ends of the body 9, and a shaft 12 laterally projecting from the central portion of one side of the body 9. Pivots 13 and 14 project from the opposite ends 10A of the arm 10. Pivots 15 and 16 project from the opposite ends 11A of the arm 11. The arm 11 has a shape resembling the letter U in plan view.

Figure 3:
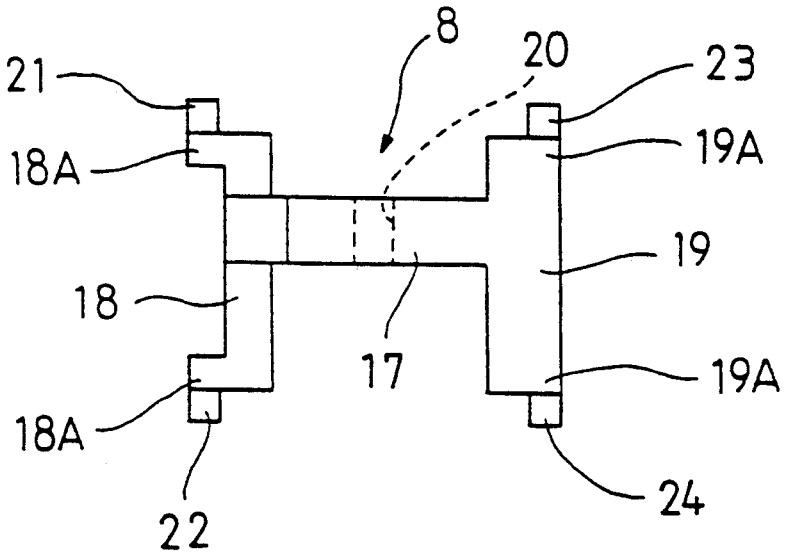
FIG. 3 is a plan view of the other support lever included in the keyswitch assembly of FIG. 1.

As shown in FIG. 3, the second support lever 8 has, in an integral unit, a body 17 and two arms 18 and 19 formed respectively at the opposite ends of the body 17. A hole 20 is formed in the central portion of the body 17 to receive the shaft 12 formed on the body 9 of the first support lever 7 to form a pivotal joint A. The arm 18 has a shape resembling the letter U in plan view, and pivots 21 and 22 project respectively from the opposite ends 18A of the arm 18. Pivots 23 and 24 project respectively from the opposite ends 19A of the arm 19.

The pair of pivots 13 and 14 of the first support lever 7 are formed diametrically opposite to a pair of pivots 15 and 16 of the first support lever 7, respectively, with respect to the axis of the shaft 12. Thus, the axes of the pivots 13, 14 and 15, 16 are the same distance from the axis of the shaft 12. The pair of pivots 21 and 22 of the second support lever 8 are formed diametrically opposite to the pair of pivots 23 and 24 of the second support lever, respectively, with respect to the center axis of a hole 20. Thus, the axes of the pivots 21, 22 and 23, 24 are the same distance from the axis of the hole 20.

As mentioned above, the support mechanism 6 is assembled by fitting the shaft 12 formed on the body 9 of the first support lever 7 in the hole 20 formed in the body 17 of the second support lever 8. The support levers 7 and 8 are able to turn on the pivotal joint A consisting of the shaft 12 and the hole 20 relative to each other.

The lower portions of the support levers 7 and 8, provided with the arms 11 and 18, are bent down so that the support levers 7 and 8 have an upward convex shape when the support levers 7 and 8 are joined together by pivotally fitting the shaft 12 in the hole 20. Thus, a relatively large space is formed under the pivotal joint A pivotally connecting the support levers 7 and 8 as shown in FIG. 1 so that a rubber spring 31 having the shape of a truncated cone can be easily accommodated in the space under the pivotal joint A.

The pivots 13 and 14 are received pivotally in holes 4 formed in the first upper projections 2 of the key 1. The pivots 15 and 16 slide along grooves 28 formed in a pair of second lower projections 26 formed in a base plate 25. The pivots 21 and 22 are fitted pivotally in round holes 29 formed in a pair of first lower projections 27 formed in the base plate 25. The pivots 23 and 24 are fitted slidably in the grooves 5 formed in the second upper projections 3 of the key 1.

The base plate 25 is disposed under the support mechanism 6. The base plate 25 is provided with connecting parts in the form of the second lower projections 26, allowing the horizontal movement of the pivots 15 and 16 of the first support lever 7 therein, and the first lower projections 27 allowing the turning of the pivots 21 and 22 of the second support lever 8 thereon.

The second lower projections 26 are preferably formed integrally with the base plate 25 so as to protrude from the upper surface of the base plate 25 and are each provided with grooves 28. The pivots 15 and 16 of the first support lever 7 are received in the grooves 28 for horizontal sliding movement along the grooves 28. Similarly, the first lower projections 27 are preferably formed integrally with the base plate 25 so as to protrude from the upper surface of the base plate 25 and are each provided with round holes 29. The pivots 21 and 22 of the second support lever 8 are received pivotally in the holes 29.

The first upper projections 2 of the key 1 and the first lower projections 27 of the base plate 25, on the left-hand side as viewed in FIG. 1 of a vertical line L passing through the center of the pivotal joint A, are provided respectively with holes 4 receiving the pivots 13 and 14 and round holes 29 receiving the pivots 21 and 22. The second upper projections 3 of the key 1 and the second lower projections 26 of the base plate 25, on the right-hand side as viewed in FIG. 1 of the vertical line L, are provided respectively with grooves 5, guiding the pivots 23 and 24 for horizontal movement, and grooves 28, guiding the pivots 15 and 16 for horizontal movement.

A flexible printed wiring or circuit board 30 provided with a printed circuit pattern including switch electrodes underlies the base plate 25. The spring 31, preferably rubber, having the shape of a truncated cone is put on the flexible printed Wiring board 30 at a position corresponding to the switch electrodes to function as a switching member. The rubber spring 31 is provided internally with a known movable electrode. The pivotal joint A pivotally connecting the support levers 7 and 8 is disposed adjacent to the central portion of the upper surface of the rubber spring 31.

When the pivotal joint A is moved downward by depressing the key 1, the pivotal joint A applies pressure to the rubber spring 31. The rubber spring 31 buckles when the compressive strain thereof exceeds a predetermined value and, consequently, the switch electrodes are short-circuited by the movable electrode contained in the rubber spring 31.

A switch support plate 32 underlies the flexible printed wiring board 30. The flexible printed wiring board 30, the rubber spring 31 and the support mechanism 6 supporting the key 1 are supported on the switch support plate 32.

The action of the keyswitch assembly will be described hereinafter. When the key 1 is depressed, the pivots 13 and 14 of the support lever 7 turn counterclockwise in the holes 4 of the first upper projections 2, the pivots 23 and 24 of the support lever 8 slide horizontally to the right, as viewed in FIG. 1, along the grooves 5 of the second upper projections 3, the pivots 21 and 22 of the support lever 8 turn clockwise in the holes 29 of the first lower projections 27 of the base plate 25, and the pivots 15 and 16 of the support lever 7 move horizontally to the right, as viewed in FIG. 1, along the grooves 28 of the second lower projections 26. Consequently, the pivotal joint A pivotally connecting the support levers 7 and 8 moves downward to compress the rubber spring 31 gradually and, upon the increase of the compressive strain of the rubber spring 31 beyond a limit, the rubber spring 31 buckles. Consequently, the movable electrode contained in the rubber spring 31 short-circuits the switch electrodes formed on the flexible printed wiring board 30 for switching.

When the key 1 is released, the resilient restoring force of the rubber spring 31 moves the pivotal joint A upward, and then, the pivots 13, 14, 21 and 22 turn in the reverse directions and the pivots 15, 16, 23 and 24 move in the reverse direction to restore the key 1 to its original position. Since the pivots 13, 14, 21 and 22 turn respectively in the holes 4 and 29 and do not move horizontally, the key 1 does not shift horizontally and moves vertically in a level position when depressed.

As mentioned above, the rubber spring 31 has the shape of a truncated cone. The inclination of the side wall thereof, which is a function of the diameter of upper surface, the diameter of the lower end and the height thereof, is dependent on the desired touch of the key 1. The height of the rubber spring 31 is dependent on the stroke of the key 1. Although a greater height is preferable, the height of the rubber spring 31 should not be very large in view of the height of the keyswitch assembly.

The support levers 7 and 8 employed in this embodiment are bent to secure a relatively large downwardly concave space under the pivotal joint A. Accordingly, the keyswitch assembly in this embodiment can be formed in a smaller height as compared with those of the keyswitch assemblies disclosed in the prior art references, the members of which corresponding to the support levers 7 and 8 of the keyswitch assembly of the present invention are straight. Further, the support levers of the present invention, can secure a larger stroke of the key as compared with those which can be secured by the keyswitch assemblies disclosed in the prior art references.

A keyswitch assembly in a second embodiment according to the present invention will be described hereinafter with reference to FIGS. 4 to 15.

Figure 4:
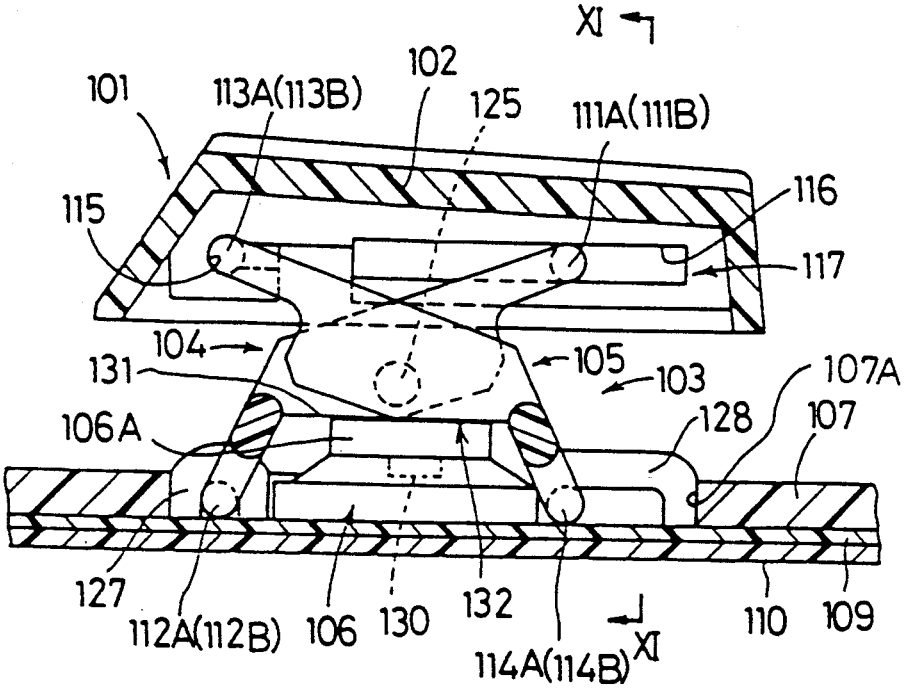
FIG. 4 is a sectional side view of a keyswitch assembly in a second embodiment according to the present invention.
Figure 5:
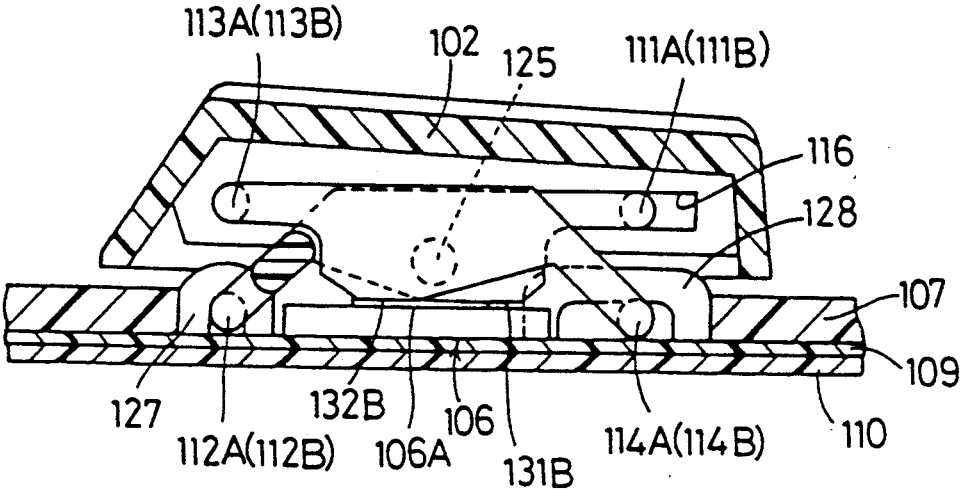
FIG. 5 is a sectional side view of the keyswitch assembly of FIG. 4 in a state where the key is depressed.

Referring to FIG. 4, a keyswitch assembly 101 comprises a key 102; a support mechanism 103 formed by pivotally joining a first support lever 104 and a second support lever 105 in a scissors-like form; a rubber spring 106 having the shape of a truncated cone, to be compressed by the support mechanism 103; a base plate 107 formed of a synthetic resin, provided with a central opening 107A and supporting the support mechanism 103 thereon; a flexible printed wiring board 109 underlying the base plate 107 with its switching elements 129 (FIGS. 12 and 13) positioned in the central opening 107A of the base plate 107; and, a reinforcing plate 110 underlying the base plate 107.

Figure 12:
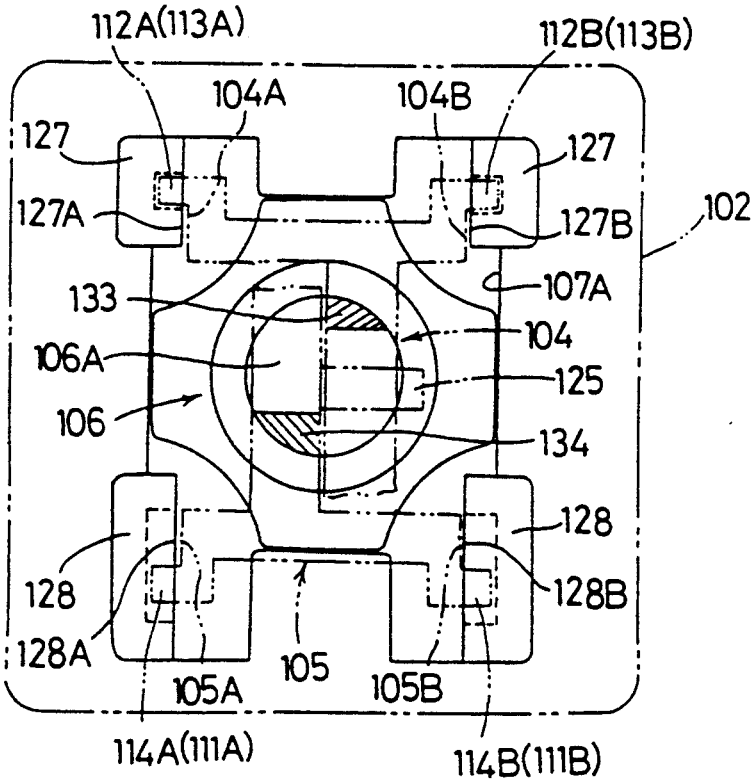
FIG. 12 is a plan view of a rubber spring fitted in a central opening.

As shown in FIGS. 4 and 12, the rubber spring 106 is fitted in the central opening 107A of the base plate 107 so as to cover the switching elements 129 (FIG. 13), i.e., electric contacts, of the printed wiring board 109. The spring 106 is preferably formed of electrically insulating silicone rubber or EPDM (ethylene-propylene diene methylene) and has, preferably in an integral piece, a circular upper wall 106A of a relatively large thickness, a side wall having the shape of the side wall of a truncated cone, and an annular flange of a relatively large thickness extending radially outward from the bottom circumference of the side wall. The upper wall 106A of the rubber spring 106 is pressed by the pressing portions of the first support lever 104 and the second support lever 105 when the key 102 is depressed. A movable contact 130 formed of a conductive rubber is fixedly attached to the inner surface of the upper wall 106A of the rubber spring 106. When the rubber spring 106 is compressed, the movable contact 130 comes into contact with the switching elements 129 to connect the switching elements 129 electrically. It is also possible to form the rubber spring 106*a* of a conductive material, such as silicone rubber containing dispensed conductive powder, such as carbon black, and therefore eliminate the need for a separate contact.

Figure 6:
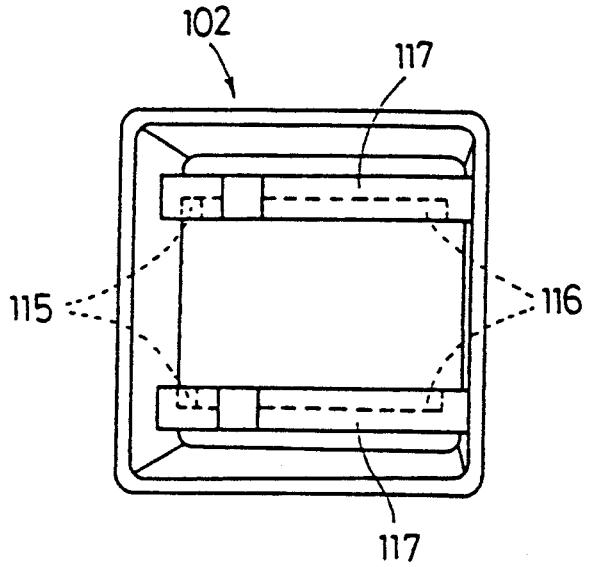
FIG. 6 is a bottom view of a key included in the keyswitch assembly of FIG. 4.
Figure 7A:
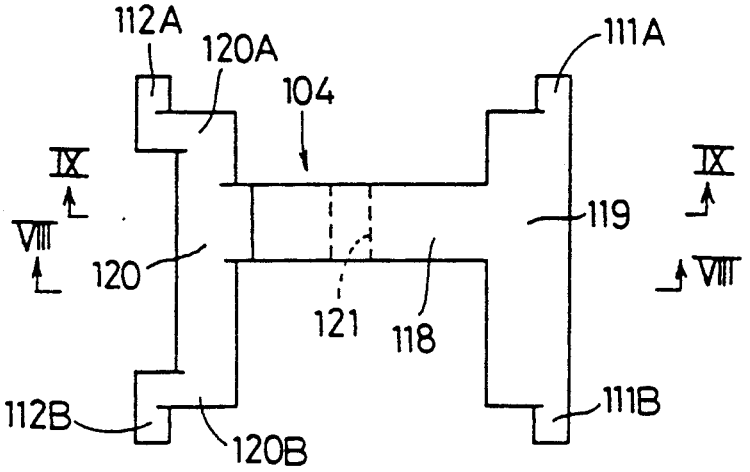
FIGS. 7(A) and 7(B) are plan views of a first support lever and of a second support lever, respectively, included in the keyswitch assembly of FIG. 4.
Figure 7B:
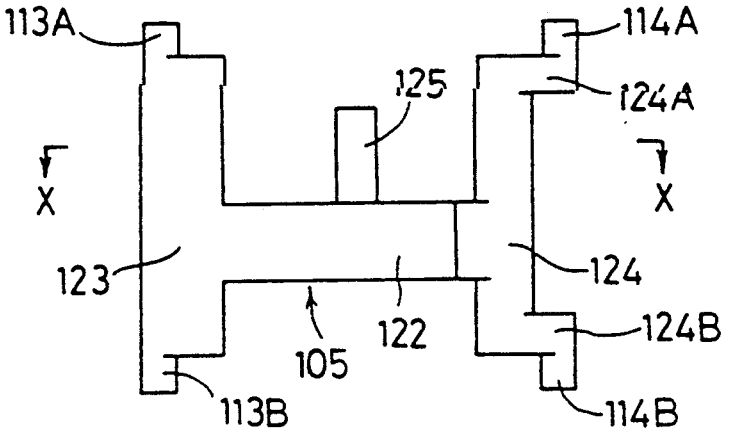
Figure 8:
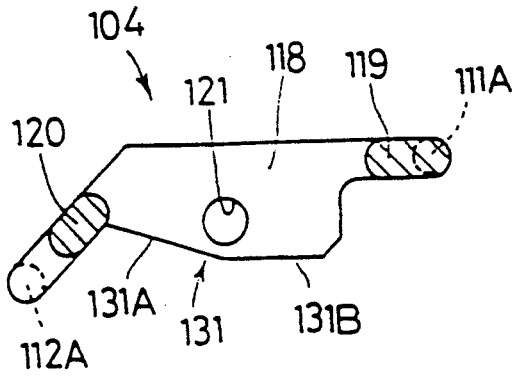
FIG. 8 is a sectional view taken in the direction of the arrows along the line VIII—VIII in FIG. 7(A)
Figure 9:
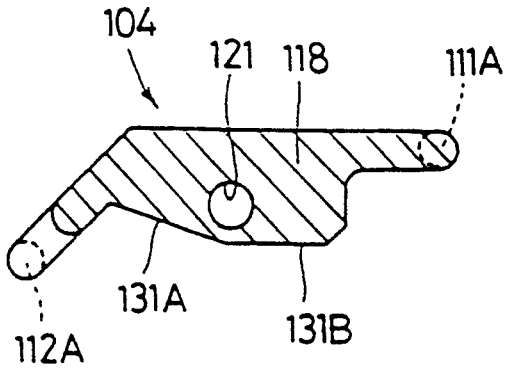
FIG. 9 is a sectional view taken in the direction of the arrows along the line IX—IX in FIG. 7(A)
Figure 10:
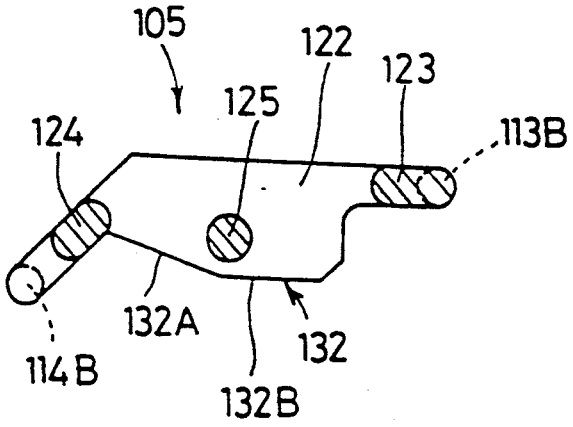
FIG. 10 is a sectional view taken in the direction of the arrows along the line X—X in FIG. 7(B)

A character such as an alphabetic character is formed by printing or the like on the upper surface of the key 102, preferably formed of a synthetic resin, such as ABS resin, by molding. As shown in FIG. 6, projections 117 are formed integrally with the key 102 on the inner surface of the key 102 or attached to the inner surface of the key 102 by adhesive for example. The projections 117 are provided with grooves 116, for guiding pivots 111A and 111B formed on the upper end of the first support lever 104 for substantially horizontal, back-and-forth movement, and holes 115 for pivotally receiving pivots 113A and 113B formed on the upper end of the second support lever 105.

The first support lever 104 and the second support lever 105 are preferably formed of a glass fiber reinforced synthetic resin. The first support lever 104 and the second support lever 105 will be described hereinafter with reference to FIGS. 7(A), 7(B) and 8 through 10. The first support lever 104 is preferably formed by molding an integral piece having a shape resembling the letter H, and has a body 118, an upper bar 119 and a lower bar 120. A hole 121 is formed laterally across the side walls of the body 118. The lower bar 120 has arms 120A and 120B extending outwardly therefrom and pivots 112A and 112B projecting from the respective extremities of the arms 120A and 120B, respectively. The outer longitudinally extending surfaces of arms 120A and 120B act as stop surfaces 104A and 104B, respectively, as seen in FIG. 12. The pivots 111A and 111B project laterally from the opposite ends of the upper bar 119, respectively.

The second support lever 105 is also preferably formed by molding an integral piece having a shape resembling the letter H and has a body 122, an upper bar 123, a lower bar 124 and a shaft 125 laterally projecting from one side surface of the body 122. In connecting the first support lever 104 and the second support lever 105, the shaft 125 is fitted in the hole 121 of the first support lever 104 so that the first support lever 104 and the second support lever 105 are able to turn relative to each other. The lower bar 124 of the second support lever 105 has arms 124A and 124B extending outwardly therefrom and provided at their extremities with pivots 114A and 114B, respectively. The outer longitudinally extending surfaces of arms 124A and 124B act as stop surfaces 105A and 105B, respectively, as seen in FIG. 12. Pivots 113A and 113B project laterally from the opposite ends of the upper bar 123. The distance between the axes of the pivot 111A and the hole 121 of the first support lever 104, the distance between the axes of the pivot 112A and the hole 121, the distance between the axes of the pivot 113A and the shaft 125 and the distance between the axes of the pivot 114A and the shaft 125 are equal to each other. Thus, the first support lever 104 turns on the pivots 112A and 112B when the support mechanism 103 performs linkage motion to maintain the key 102 in a position parallel to the upper surface of the base plate 107 during vertical movement.

The respective lower surfaces of the body 118 of the first support lever 104 and the body 122 of the second support lever 105 have downward convex polygonal pressing portions 131 and 132, respectively. The pressing portions 131 and 132 apply pressure to the upper surface of the upper wall 106A of the rubber spring 106.

The pressing portion 131 of the first support lever 104 and the pressing portion 132 of the second support lever 105 are substantially the middle portions of the lower surfaces of the bodies 118 and 122, respectively. The pressing portion 131 consists of two flat surfaces 131A and 131B meeting substantially at the middle of the lower surface of the body 118 at an obtuse angle, and the pressing portion 132 consists of two flat surfaces 132A and 132B meeting substantially at the middle of the lower surface of the body 122 at an obtuse angle.

The positional relation between the flat surfaces 131A and 131B with respect to the hole 121, and the positional relation between the flat surfaces 132A and 132B with respect to the shaft 125 are symmetrical.

Figure 13:
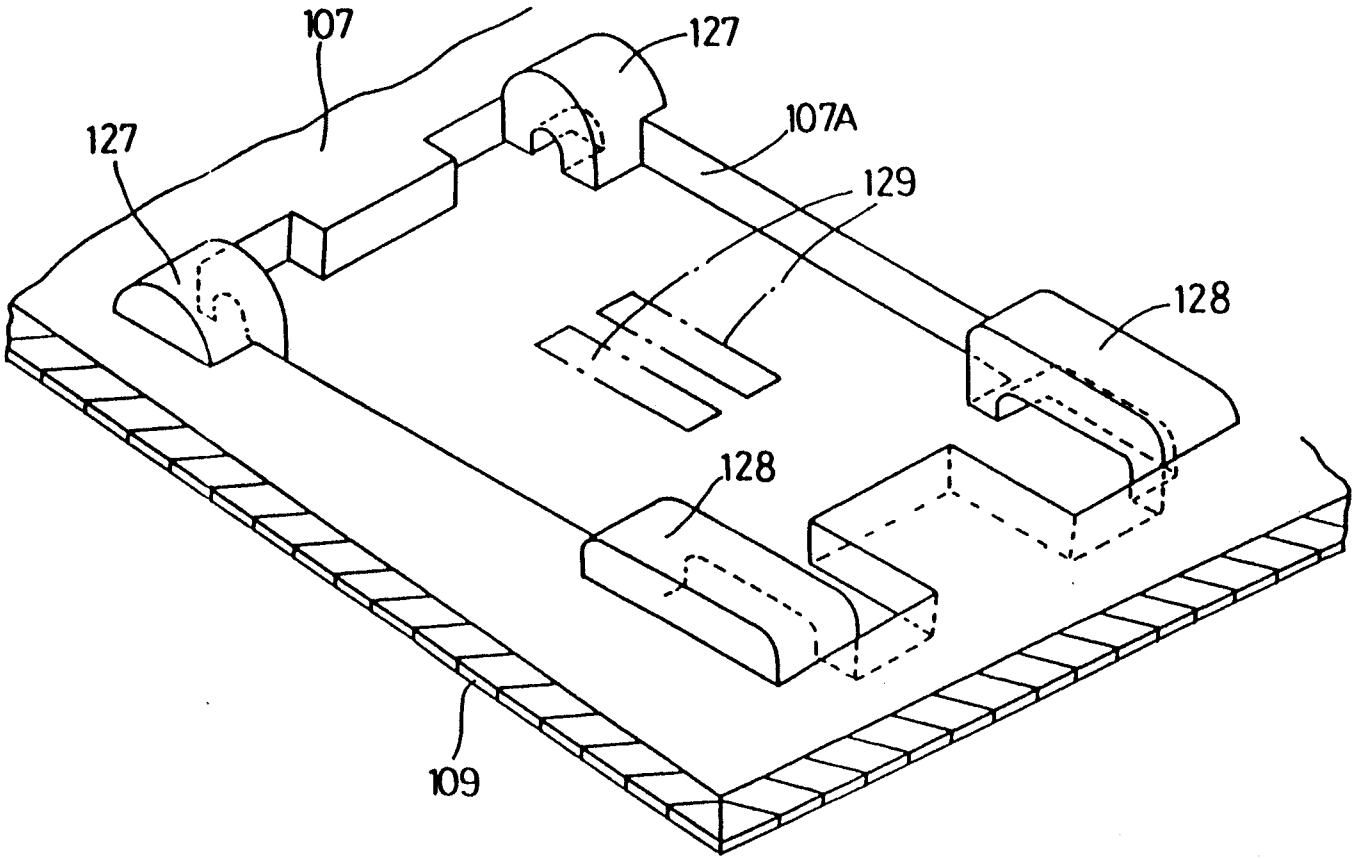
FIG. 13 is a perspective view of a portion of a base plate provided with a central opening.

As shown in FIGS. 12 and 13, the base plate 107, preferably formed of a glass fiber reinforced synthetic resin, is provided with a substantially rectangular central opening 107A. The flange of the rubber spring 106 fits the central opening 107A. The base plate 107 is provided with a pair of upwardly extending protrusions defining round recesses 127 opening downward respectively at the opposite corners on one end of the central opening 107A and a pair of upwardly extending protrusions defining longitudinally elongate slots or grooves 128 opening downward respectively at the opposite corners on the other end of the central opening 107A. The upwardly extending protrusions defining recesses 127 each have opposed facing lateral stop surfaces 127A and 127B, the upwardly extending protrusions defining grooves 128 each have opposed facing lateral stop surfaces 128A and 128B. The base plate 107 is preferably formed by injection molding.

The pivots 112A and 112B of the first support lever 104 are received pivotally in the round recesses 127, and the pivots 114A and 114B of the second support lever 105 are received in the elongate grooves 128 for longitudinal movement. The pivots 112A and 112B are held in the round recesses 127 and the pivots 112A and 112B are held in the elongate grooves 128 by attaching the printed wiring board 109 to the lower surface of the base plate 107.

Figure 11:
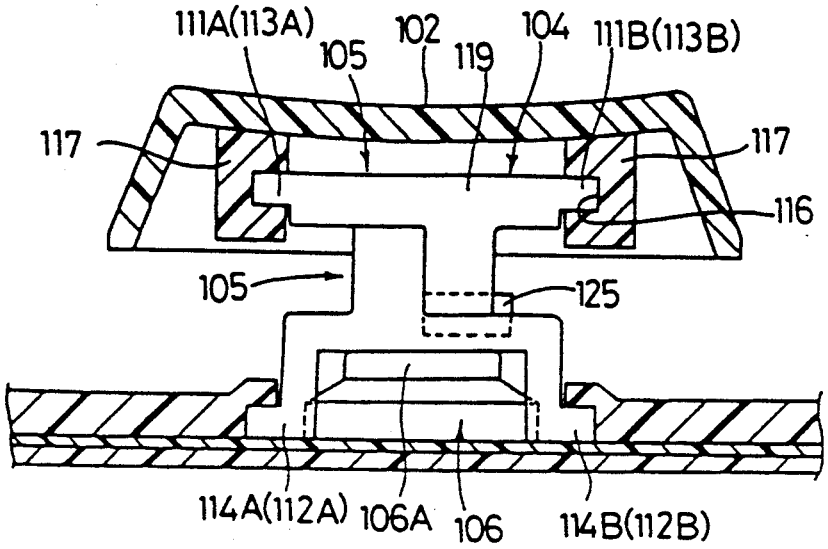
FIG. 11 is a sectional side view taken in the direction of the arrows along the line XI—XI in FIG. 4.

The shapes and sizes of the pivots 111A, 111B, 112A, 112B, 113A, 113B, 114A and 114B, the lateral stop surfaces 104A, 104B, 105A and 105B, the holes 115, the grooves 116, the recesses 127 and stop surfaces 127A and 127B, and the elongate grooves 128 and stop surfaces 128A and 128B are determined so that the first support lever 104 and the second support lever 105 are laterally immovable, namely, movable neither to the right nor to the left as viewed in FIG. 11. The pivots 111A and 111B and the pivots 114A and 114B are able to slide smoothly respectively along the grooves 116 and the elongate grooves 128, and the extremities of the pivots are in sliding contact with the bottom surfaces of the corresponding round holes and the corresponding elongate grooves. Accordingly, the shaft 125 is unable to come out of the hole 121.

Figure 17C:
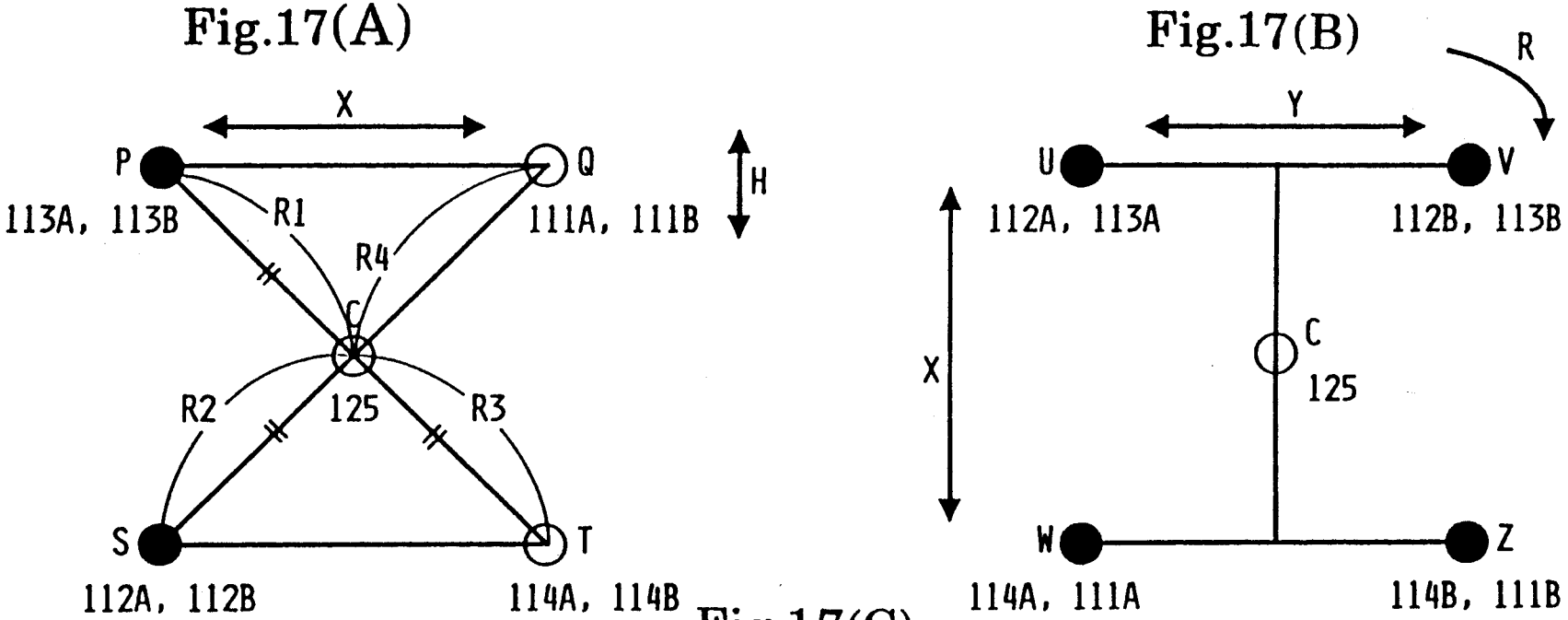
FIG. 17(C) is a chart explaining the movement arrows in FIGS. 17(A) and 17(B)

Referring to FIGS. 17(A), 17(B) and 17(C), the movement of the key support mechanism 103 shown in FIG. 4 is schematically depicted. The levers 104 and 105 are pivotally connected at pivot axis C along shaft 125. As shown, the distance between at least three, and preferably all, of the pivots and the pivot axis is the same. Specifically, the distance R1 between the pivot axis connecting pivots 113*a* and 113*b*, shown as point P in FIG. 17(A), and the pivot axis C, the distance R2 between the pivot axis connecting pivots 112*a* and 112*b*, shown as point S in FIG. 17(A), and the pivot axis C, the distance R3 between the pivot axis connecting pivots 114*a* and 114*b*, shown as point T in FIG. 17(A), and the pivot axis C, and the distance R4 between the pivot axis connecting pivots 111*a* and 111*b*, shown as point Q in FIG. 17(A), and the pivot axis C are equal. This relationship limits the longitudinal, transverse and rotational movement of the key as described below.

Since R1, R2 and R3 are equal, the upper end P of the lever 105 and the lower end S of the lever 104 are not slidable in the longitudinal or X direction as shown by the arrow X in FIGS. 17(A) and 17(B) and described in the "X" row in the chart of FIG. 17(C).

Figure 18:
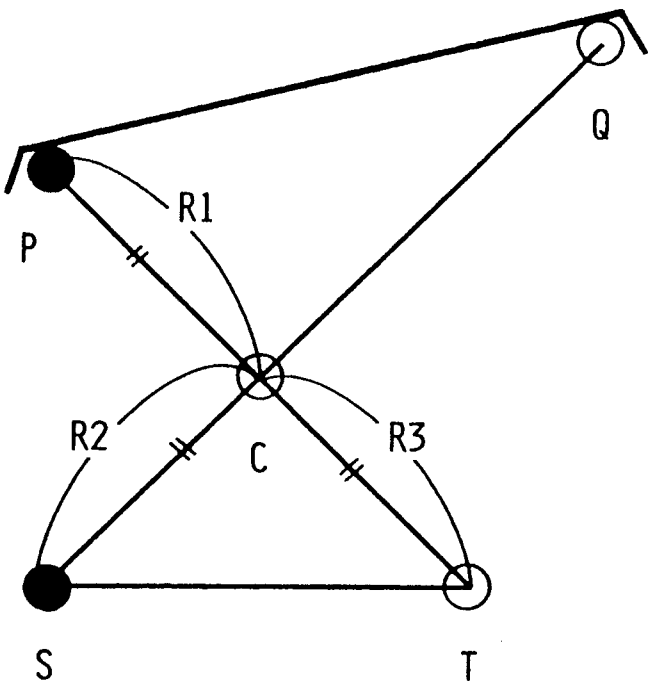
FIG. 18 is a schematic side view of a modification of the assembly shown in FIG. 17(A) for an inclined key.

In addition, when the distances R1, R2, R3 and R4 are equal, the upper end P of lever 105 and the lower end S of lever 104 are not slidable in the X direction which prevents longitudinal rotation about the X axis and lateral rotation about the Y axis. Thus, the key remains horizontally level and does not tilt as shown by the H arrow in FIG. 17 (A) and described in the "H" row of FIG. 17(C). Preferably, the distance R4 is the same as R1, R2 and R3 for stability. However, as shown in the embodiment of FIG. 18, if R4 is a different length than R3, longer for example, the key will be inclined but still immovable in the X direction.

Also, due to the lateral stop surfaces on the levers and the connecting parts discussed above, all of the ends of the levers 104 and 105 labelled as points U, V, W and Z are laterally immovable in the Y direction as shown by the Y arrow in FIG. 17(B) and described in the "Y" row in FIG. 17(C).

Further, the vertically aligned lower end 112*b* of one side of the lower arm 120*b* of lever 104 and the upper end 113*b* of one side of the upper arm 123 of lever 105, labelled as point U in FIG. 17(B), and the vertically aligned lower end 112*a* of the other side of the lower arm 120*a* of lever 104 and the upper end 113*a* of the other side of upper arm 123 of lever 105, labelled as point V in FIG. 17(B) are not slidable in the X direction which prevents rotation about the vertical or Z axis as depicted by arrow R in FIG. 17(B) and described in the "R" row of the chart of FIG. 17(C). The key support mechanisms of each embodiment operates in the same manner with the above described spacial relationships.

Thus, all directions of movement of the key, except the vertical direction with respect to the base plate, are restrained by the spacial arrangement of the ends of the levers, i.e. the pivots, with respect to the central pivot axis of the linkage and by the lateral stop surfaces on the levers and on the base plate and key. Also, the movement of the key in the vertical direction is limited by the ends of the elongated slots on the keys and the base plate. The result is an extremely stable key which will not tilt or turn regardless of where the operator presses on the surface of the key.

Figure 16:
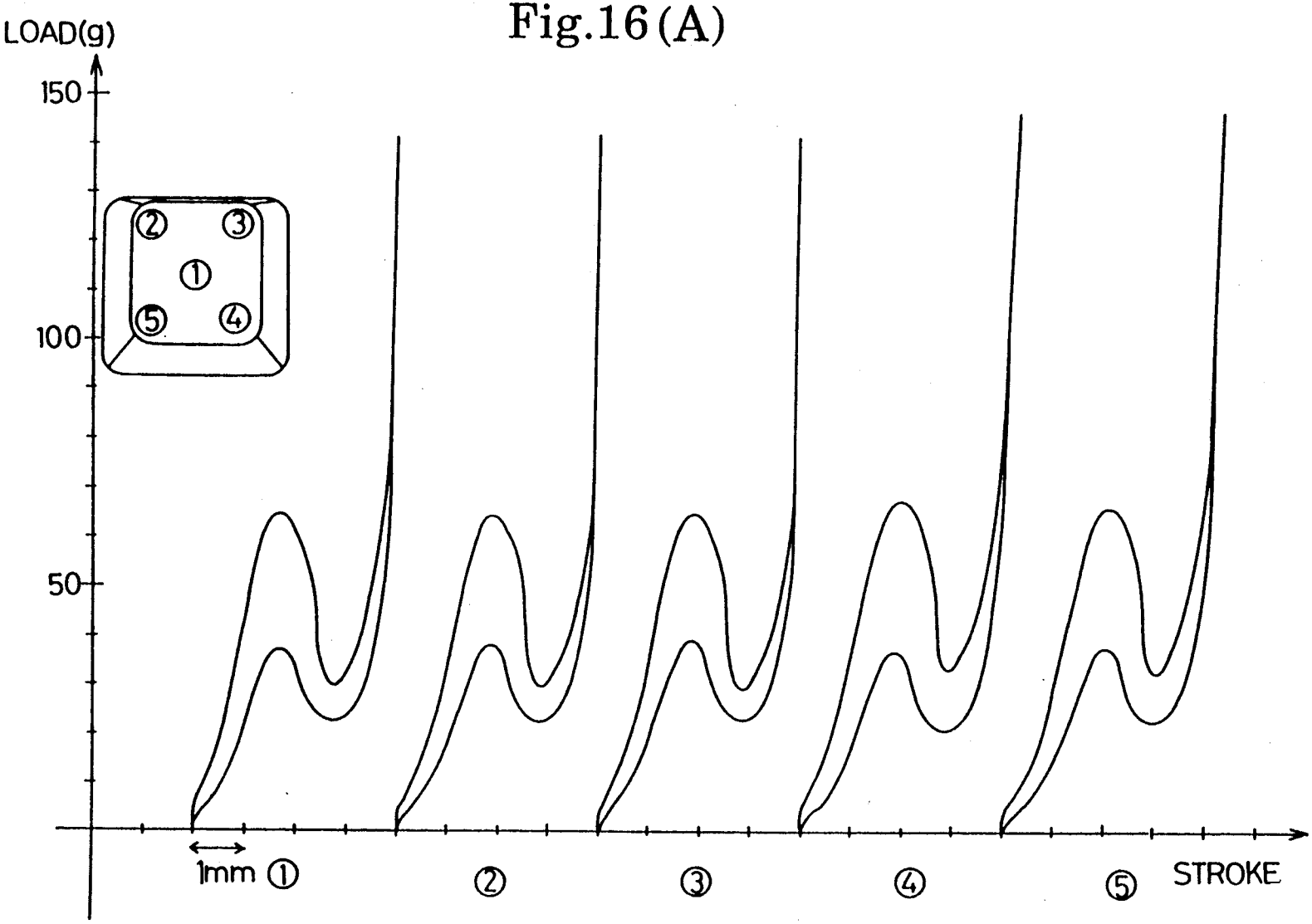
FIG. 16(A) is a graph of the load per stroke of the key assembly according to the present invention for five different application points on the key surface.
FIG. 16(B) is a graph of the load per stroke of a prior art key assembly for five different application points on the key surface.

As shown in FIG. 16(A), regardless of where an operator contacts the surface of the key to depress the key support mechanism, the load is uniform. Specifically, if the operator contacts the key at the center thereof, position "1" shown in FIG. 16(A), the same load is applied to the key support mechanism as if the operator contacted the key in the corner thereof, at position "3" for example. Since the load is uniform, the counter force perceived by the operator is the same. Thus, accurate operation of the keyboard is ensured since satisfactory tactile feedback upon contact with the key is always provided and a uniform pressure to the keys will properly actuate the switch.

Figure 16B:
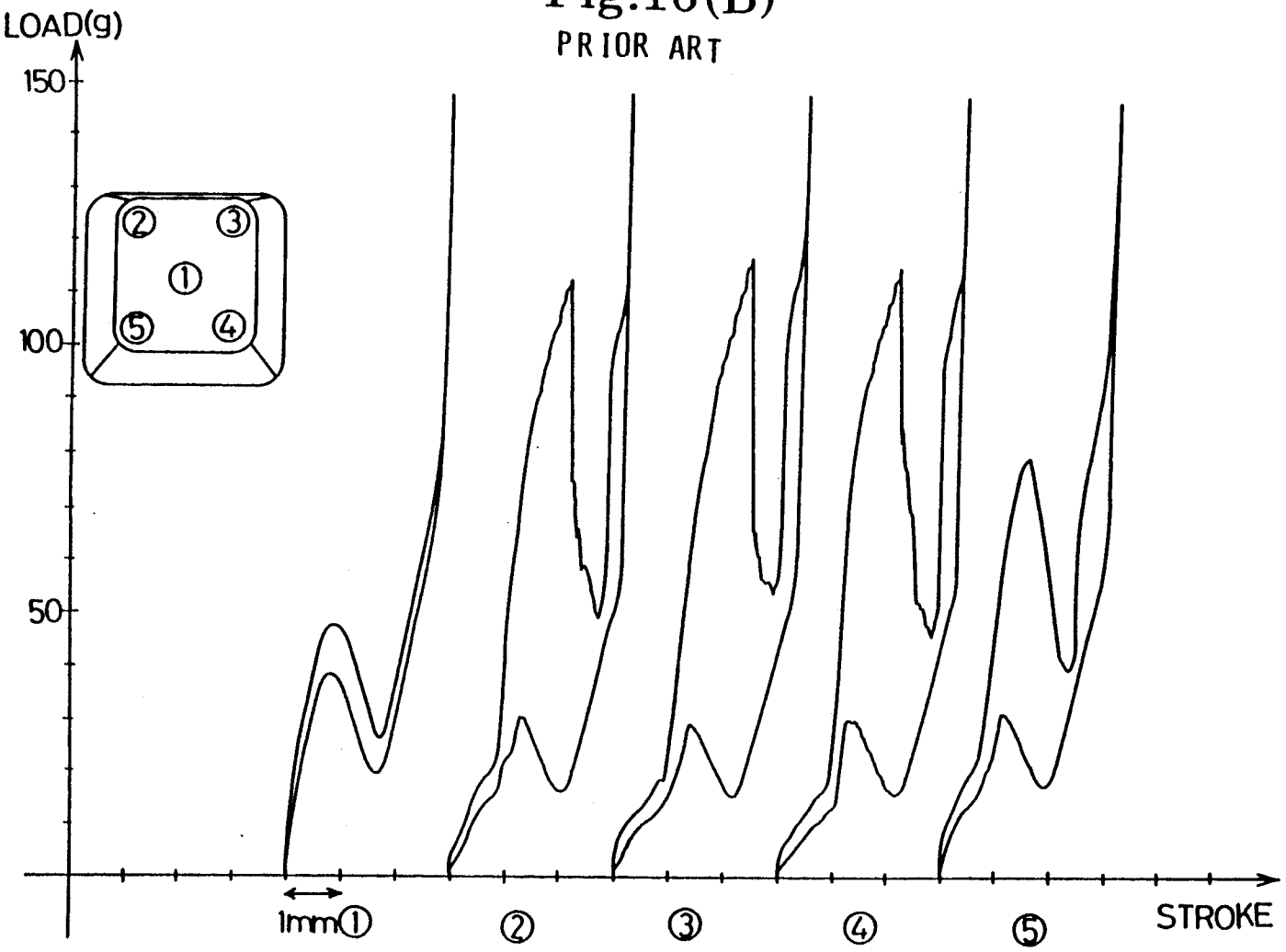
Fig.16(B) PRIOR ART

In distinction, FIG. 16(B) illustrates a prior art key in which the load and thus the counter force perceived by the operator and the force required to actuate the switch varies with contact positions on the key. For example, when the corners of the key are contacted, the load is much greater and unstable as compared to the load resulting from center contact. Therefore, operation of the keyboard is not smooth, and the tactile feedback of the keys is unsatisfactory which may result in errors.

When the key 102 is depressed, the first support lever 104 turns clockwise, as viewed in FIG. 4, on the pivots 112A and 112B fitted in the round recesses 127 of the base plate 107, and the second support lever 105 turns counterclockwise, as viewed in FIG. 4, on the shaft 125 thereof. At the initial stage of downward movement of the key 102, the flat surface 131A of the body 118 of the first support lever 104 nearer to the lower bar 120 and the flat surface 132A of the body 122 of the second support lever 105 nearer to the lower bar 124 are pressed against shaded contact regions 133 and 134 (FIG. 12) in the upper surface of the upper wall 106A of the rubber spring 106 to compress the rubber spring 106.

As the key 102 is depressed further, a portion of the body 118 around the edged junction of the flat surfaces 131A and 131B and a portion of the body 122 around the edged junction of the flat surfaces 132A and 132B are pressed against the upper surface of the upper wall 106A of the rubber spring 106.

As the key 102 is depressed still further, the flat surface 131B of the body 118 of the first support lever 104 nearer to the upper bar 119 and the flat surface 132B of the body 122 of the second support lever 105 nearer to the upper bar 123 are pressed against contact regions in the upper surface of the upper wall 106A of the rubber spring 106 on the other side of the diameter with respect to the shaded contact regions 133 and 134 to compress the rubber spring 106.

Figure 14:
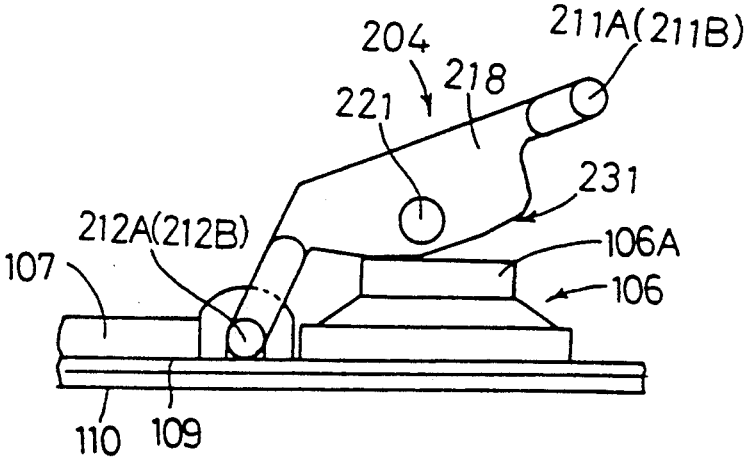
FIG. 14 is a side view of a first support lever employed in a keyswitch assembly in a third embodiment according to the present invention.

A key switch assembly in a third embodiment according to the present invention is a modification of the keyswitch assembly in the second embodiment. This keyswitch assembly employs a first support lever 204 as shown in FIG. 14 and a second support lever 205. The first support lever 204 has a body 218 having a pressing portion 231 on its lower surface. The pressing portion 231 consists of three flat surfaces forming a polygonal surface having edges substantially parallel to the axis of a hole 221. The shape of the second support lever is substantially the same as that of the first support lever 204 and has a pressing portion 234 consisting of three flat surfaces forming a polygonal surface similar to that formed by the three flat surfaces of the first support lever 204.

Figure 15A:
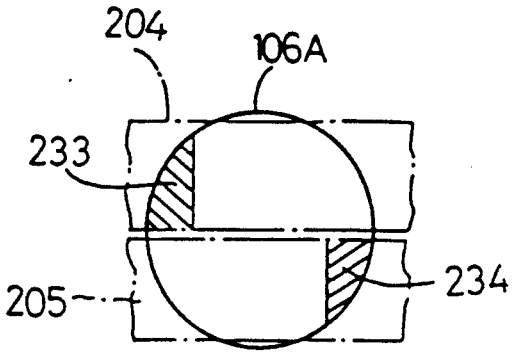
FIGS. 15(A) , 15(B) and 15(C) are plan views of assistance in explaining the shift of pressing regions on the upper surface of the rubber spring with the downward movement of the key of the keyswitch assembly of FIG. 14.
Figure 15B:
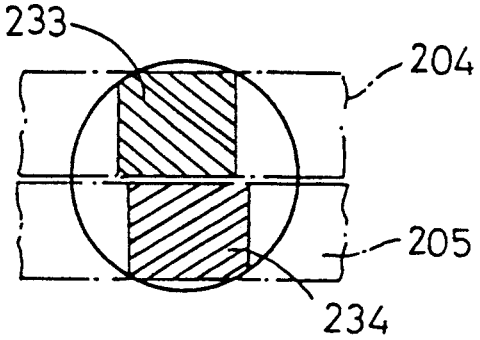
Figure 15C:
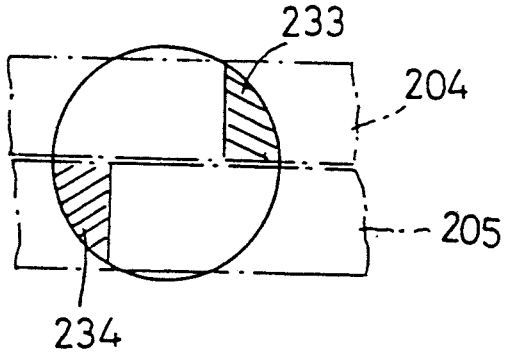

Referring to FIGS. 15(A), 15(B) and 15(C), when the key is depressed, the first support lever 204 presses the upper half of the upper wall 106A of the rubber spring 106 and the second support lever 205 presses the lower half of the upper wall 106A of the rubber spring 106. At the initial stage of the downward movement of the key, the first support lever 204 is in contact with a contact region 233, i.e., a shaded region in FIG. 15(A), on the far left end of the upper half of the upper wall 106A and the second support lever 205 is in contact with a contact region 234, i.e., a shaded region in FIG. 15(A), on the far right end of the lower half of the upper wall 106A. As the key 102 is depressed further, the contact region 233 shifts to the right and the contact region 234 shifts to the left as shown in FIGS. 15(B) and 15(C).

Since the respective pressing portions 231 and 232 of the first support lever 204 and the second support lever 205 are downward convex polygonal surfaces, the upper wall 106A of the rubber spring 106 is pressed by the edges between the adjacent flat surfaces forming the pressing portions 231 and 232 only a short period of time, which makes the touch of the key, particularly, the tactile feedback characteristic of the key, namely, the sharp change in the resistance of the key against depression at a moment when the electric contact is closed during the depression of the key, become satisfactory and hence enables stable keystroke operation.

The pressed region in the upper half of the upper wall 106A and the pressed region in the lower half of the upper wall 106A shift respectively in opposite directions as the key 102 moves downward, the upper and lower portions, as viewed in FIG. 12, i.e., the right and left portions, as viewed in FIGS. 15(A) to 15(C), of the upper wall 106A of the rubber spring 106 are pressed substantially evenly in the substantially symmetrical regions. Consequently, all portions of the side wall of the rubber spring 106 buckle substantially simultaneously.

The flexible printed wiring board 109 having the switching elements 129 may be substituted by a membrane switch.

The flat surfaces forming the pressing portions 231 and 232 of the first support lever 104 and the second support lever 105 may be connected by gently curved surfaces, respectively.

The areas of contact between the pressing portions of the first and second support levers 204 and 205, and the upper surface of the rubber spring 106 in pressing the upper wall 106A of the rubber spring 106 by the pressing portions 231 and 232 of the first support lever 204 and the second support lever 205 are relatively large, because each of the pressing portions 231 and 232 consists of a plurality of flat surfaces. If the number of the flat surfaces forming each pressing portion is increased, the obtuse angle between the adjacent two flat surfaces approaches 180°, and each of the flat surfaces of the pressing portions fits the soft upper wall of the rubber spring 106 and presses the upper wall 106A of the rubber spring 106 in a wide region of the upper surface, which enables stable keystroke operation and give a satisfactory touch of the key 102.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A keyswitch assembly comprising:

a key;

a base plate disposed beneath said key;

key support supporting said key for perpendicular movement with respect to said base plate, and comprising first and second levers pivotally joined and forming a scissors-type mechanism with a pivot axis, said first lever having a first end pivotally connected to said key and a second end slidably connected to said base plate, said second lever having a first end slidably connected to said key and a second end pivotally connected to said base plate; and a switching member disposed between said base plate and said key support, wherein upon depression of said key, said key support bears on said switching member to actuate switching.

2. The keyswitch assembly according to claim 1 wherein said switching member is a rubber spring.

3. The keyswitch assembly according to claim 1 wherein said switching member is an inverted truncated cone having a base flange, a flexible conical side wall and a top wall with an upper and a lower surface, said side wall buckling when said key support means bears on said upper surface and wherein an electrical contact is disposed on said lower surface within said switching member.

4. The keyswitch assembly according to claim 1 wherein said first and second levers delineate a downwardly concave space in which said switching member is disposed.

5. The keyswitch assembly according to claim 1 wherein each of said levers has an upper arm, a lower arm and a body, said upper arm and said lower arm extending perpendicularly from said body, and a pair of opposed pivots extending from each end of said upper arm and said lower arm.

6. The keyswitch assembly according claim 1, wherein said key support includes a bearing surface located at said pivot axis for bearing on said switching member.

7. The keyswitch assembly according to claim 6, wherein said bearing surface is semi-circular.

8. The keyswitch assembly according to claim 6, wherein said bearing surface includes two surfaces disposed at an obtuse angle on each said first and second levers, said angle being aligned with said pivot axis.

9. The keyswitch assembly according to claim 6, wherein each lever has a polygonal body which acts as the bearing surface.

10. The keyswitch assembly according to claim 6, wherein said bearing surface has at least two obtuse angles.

11. The keyswitch assembly according to claim 1, wherein said first lever has a shaft extending laterally therefrom and said second lever has a hole extending laterally therethrough, said shaft being rotatably secured in said hole.

12. The keyswitch assembly according to claim 1, wherein said second end of said first lever and said first end of second lever slide longitudinally with respect to said key and said base plate.

13. The keyswitch assembly according to claim 12, wherein said first end of said first lever, said second end of said first lever and said second end of said second lever are equally spaced from said pivot axis, and said first end of said first lever and said second end of said second lever are longitudinally immovable.

14. The keyswitch assembly according to claim 13, wherein said first end of said first lever has a pair of opposed ends aligned along a first line connecting said pair of ends, said second end of said first lever has a pair of opposed ends aligned along a second line connecting said pair of ends, and said second end of said second lever has a pair of opposed ends aligned along a third line connecting said pair of ends, wherein a shortest distance between said first line and said pivot axis, a shortest distance between said second line and said pivot axis and a shortest distance between said third line and said pivot axis are the same.

15. The keyswitch assembly according to claim 13, wherein said first end of said second lever is the same distance from said pivot axis as said second end of said first lever, and said lower surface of said key remaining level with respect to movement of said key.

16. The keyswitch assembly according to claim 15, wherein said first end of said second lever has a pair of opposed ends aligned along a fourth line connecting said pair of ends, wherein a shortest distance between said fourth line and said pivot axis is the same as the shortest distance between said second line and said pivot axis.

17. The keyswitch assembly according to claim 13, wherein said first end of said second lever is spaced an unequal distance from said pivot axis compared to, the distance between said second end of said first lever and said pivot axis.

18. The keyswitch assembly according to claim 13, wherein said first and second levers have lateral stop surfaces and said key is laterally immovable.

19. The keyswitch assembly according to claim 1, comprising a normal axis perpendicular to said base plate extending from said key to said base plate, wherein said first end of said first lever and said second end of said second lever are aligned along a plane parallel to said normal axis.

20. The keyswitch assembly according to claim 1, comprising a normal axis perpendicular to said base plate extending from said key to said base plate, wherein said second end of said first lever and said first end of said second lever are aligned along a plane parallel to said normal axis.

21. A keyswitch assembly comprising:

a key;

a base plate disposed beneath the key;

key support supporting said key for perpendicular movement with respect to said base plate, said key support pivotally coupled to said key and said base plate.

a switch having an electrical contact for making electrical connection upon movement of said kay, positioned beneath said key support, wherein said key support contacts and compresses said switch upon movement of said key.

22. The keyswitch assembly according to claim 21, wherein said switch is a resilient inverted cup.

23. The keyswitch assembly according to claim 21, wherein said key support comprises a pair of levers pivotally joined in a scissors arrangement having a pivot axis.

24. The keyswitch assembly according to claim 23, wherein a lower portion of said levers surrounds said switch, and said key support bears on said switch at said pivot axis.

25. The keyswitch assembly according to claim 21, wherein said key support means has a semi-circular surface which confronts said switch.

26. The keyswitch assembly according to claim 21, wherein said key support means has an angular surface having at least one obtuse angle which confronts said switch.

27. The keyswitch assembly according to claim 21, further comprising a printed circuit board positioned beneath said base plate and wherein said base plate has an opening and said switch is positioned within said opening on said print circuit board.

28. The keyswitch assembly according to claim 21, wherein a pair of electrical contacts are disposed beneath said switch and said switch has an electrical contact movable to said pair of contacts upon depression of said key.

29. The keyswitch assembly according to claim 21, wherein said key is laterally, longitudinally and rotatably immovable.

30. A keyswitch assembly comprising:

a key adapted to be depressed and having at least two first connecting parts;

a switch for switching action actuated upon depression of said key;

a base plate disposed beneath said key for supporting said switch and having at least two second connecting parts;

a scissors-type linkage supporting said key and having first, second, third and fourth ends and a pivot axis, said first end pivotally fixed to said first connecting parts, said second end movably connected to said first connecting parts, said third end pivotally fixed to said second connecting parts and said fourth end movably connected to said second connecting parts, said key adapted to be depressed perpendicularly with respect to said base plate and said linkage actuating said switch upon depression of said key, wherein a distance between said first end and said pivot axis, a distance between said third end and said pivot axis and a distance between said fourth end and said pivot axis are the same.

31. The keyswitch assembly according to claim 30, comprising a normal axis extending from said key to said base plate wherein said first end and said third end are aligned along a plane parallel to said normal axis.

32. The keyswitch assembly according to claim 30, wherein said first end, a point on said pivot axis and said fourth end are linearly aligned.

33. The keyswitch assembly according to claim 30, wherein said second end is spaced from said pivot axis the same distance as the distance between said first end and said pivot axis.

34. The keyswitch assembly according to claim 30, comprising a normal axis extending from said key to said base plate, wherein said second end and said fourth end are aligned along a plane parallel to said normal axis.

35. The keyswitch assembly according to claim 30, wherein said second end is spaced from said pivot axis an unequal distance compared to the distance between said first end and said pivot axis.

36. The keyswitch assembly according to claim 30, wherein said key has a longitudinal axis and a transverse axis and said first and second connecting parts have stop means for stopping movement of all of the ends of the levers with respect to said transverse axis and for limiting movement of said second end and said fourth end with respect to said longitudinal axis.

37. The keyswitch assembly according to claim 30, wherein said key has a longitudinal axis and said second end and said fourth end are slidable with respect to said longitudinal axis.

38. A keyswitch assembly comprising:

a key having a lower surface provided with at least two first connecting parts;

a base plate having an upper surface disposed below the key and provided with at least two second connecting parts positioned to correspond to the first connecting parts;

a key support comprising a pair of pivotally connected first and second levers, said first lever having a pair of upper ends pivotally coupled to one of the first connecting parts and a pair of lower ends slidingly coupled to one of the second connecting parts and said second lever having a pair of upper end slidingly coupled to another of the first connecting parts and a pair of lower ends pivotally coupled to another of the second connecting parts for supporting the key for perpendicular movement with respect to the base plate, the key support having a downwardly concave space located above the base plate; and a switching member disposed between the key support and the base plate within the downwardly concave space of the key support and actuated for switching said key support.

39. The keyswitch assembly according to claim 38, wherein the key support comprises a scissors-type linkage with a pivot axis, the switching member being disposed directly below the pivot axis so as to be operated for switching action when the key is depressed.

40. The keyswitch assembly according to claim 39, wherein the pair of upper ends of the first lever and the pair of lower ends of the second lever are longitudinally immovable and aligned along a plane generally perpendicular to the upper surface of the base plate.

41. The keyswitch assembly according to claim 39, wherein the pair of upper ends of the first lever, the pair of lower ends of the first lever and the pair of lower ends of the second lever are equally spaced from the pivot axis.

42. The keyswitch assembly according to claim 38, wherein the first and second connecting parts have stops which limit movement of the key.

43. A keyswitch assembly comprising:

a key;

a base plate disposed under said key;

a key support for supporting said key for movement with respect to said base plate, and comprising a first member and a second member joined and forming a scissors-type mechanism with a pivot axis, said first member having a first end connected to said key and a second end connected to said base plate, said second member having a first end connected to said key and a second end connected to said base plate, said first end of said first member and said second end of said second member being longitudinally immovable with respect to said key; and a switching member disposed under said key support and operated by said key support for switching by when said key is depressed.

44. The keyswitch assembly according to claim 43, wherein said first end of said first member and said second end of said second member are laterally immovable with respect to said key.

45. The keyswitch assembly according to claim 43, wherein said first end of said first member, said second end of said first member and said second end of said second member are equally spaced from said pivot axis.

46. The keyswitch assembly according to claim 45, wherein said first end of said second member is the same distance from said pivot axis as said second end of said first member, wherein said key remains horizontal with respect to the vertical movement of said key.

47. The keyswitch assembly according to claim 45, wherein said first end of said first member has a pair of opposed ends aligned along a first line connecting said pair of ends, said second end of said first member has a pair of opposed ends aligned along a second line connecting said pair of ends, and said second end of said second member has a pair of ends aligned along a third line connecting said pair of ends, wherein a shortest distance between said first line and said pivot axis, a shortest distance between said second line and said pivot axis and a shortest distance between said third line and said pivot axis are the same.

48. The keyswitch assembly according to claim 47, wherein said first end of said second member has a pair of opposed ends aligned along a fourth line connecting said pair of opposed ends, and a shortest distance between said fourth line and said pivot axis is the same as said shortest distance between said second line and said pivot axis.

49. The keyswitch assembly according to claim 45, further comprising a normal axis extending from said key to said base plate, wherein said first end of said first member and said second end of said second member are aligned along a plane parallel to said normal axis.

50. The keyswitch assembly according to claim 49, wherein said first end of said first member, a center point on said pivot axis and said second end of said first member are linearly aligned.

51. The keyswitch assembly according to claim 45, further comprising a normal axis extended from said key to said base plate, wherein said first end of said second member and said second end of said first member are aligned along a plane parallel to said normal axis.

52. The keyswitch assembly according claim 43, wherein said key has at least two first connecting parts and said base plate has at least two second connecting parts, said first end of said first member is pivotally connected to one of said first connecting parts and said second end of said second member is pivotally connected to one of said second connecting parts.

53. The keyswitch assembly according to claim 52, wherein said first end of said second member is slidably connected to another of said first connecting parts and said second end of said first member is slidably connected to another of said second connecting parts.

54. The keyswitch assembly according to claim 53, wherein said first and second connecting parts have stop means for stopping lateral movement with respect to the key.

55. The keyswitch assembly according to claim 43, wherein said switching member is positioned beneath said key support and said key support contacts and compresses said switching member upon vertical movement of said key.

56. The keyswitch assembly according to claim 55, wherein said second end of said first member has a first pair of opposed ends and said second end of said second member has a second pair of opposed ends, and wherein said first pair of opposed ends and said second pair of opposed ends surround said switching member, and said key support bears on said switching member at said pivot axis.

57. The keyswitch assembly according to claim 55, wherein said key support includes a bearing surface located at said pivot axis for bearing on said switching member and said bearing surface has at least two surfaces disposed at an obtuse angle to each other on each said first member and said second member.

58. The keyswitch assembly according to claim 57, wherein said key support comprises a polygonal body for bearing on said switching member.

59. The keyswitch assembly-according to claim 43, wherein said key support has a downwardly concave space located above said base plate and said switching member is disposed between said key support and said base plate within said downwardly concave space of said key support.

60. The keyswitch assembly according to claim 43, wherein said first end of said first member has a first pair of opposed ends, said first end of said second member has a second pair of opposed ends, said second end of said second member has a third pair of opposed ends and said second end of said first member has a fourth pair of opposed ends, and wherein said first, second, third and fourth pair of opposed ends form an area surrounded by their ends, and said switching member is positioned within said area.

61. The keyswitch assembly according to claim 43, wherein said first member is a first lever and said second member is a second lever.

62. The keyswitch assembly according to claim 43, wherein said first end, said second end and said pivot axis of each of said first and said second members are linearly aligned.

* * * * *